US005600984A

United States Patent [19]

Sheen

[11] Patent Number: 5,600,984

[45] Date of Patent: Feb. 11, 1997

[54] DEVICE FOR BENDING TUBES

[76] Inventor: Reen-Yuan Sheen, P.O. Box 82-144, Taipei, Taiwan

[21] Appl. No.: 661,119

[22] Filed: Jun. 10, 1996

[51] Int. Cl.[6] ..... B21F 3/04; B21F 3/02

[52] U.S. Cl. ..... 72/145; 72/135

[58] Field of Search ..... 72/135, 137, 143, 72/144, 145, 146, 367, 369

[56] References Cited

U.S. PATENT DOCUMENTS

| | | | |
|---|---|---|---|
| 1,505,347 | 8/1924 | Hoyt | 72/145 |
| 2,771,934 | 11/1956 | Payne | 72/144 |
| 3,893,324 | 7/1975 | Cappell | 72/143 |

*Primary Examiner*—Lowell A. Larson
*Assistant Examiner*—Rodney A. Butler
*Attorney, Agent, or Firm*—Alfred Lei

[57] ABSTRACT

A device for bending tubes including a platform, a feeding mechanism having a sliding seat, a pair of lugs, and a chuck, a chuck controlling mechanism having a direction controller and a chuck driving gearing, an idle gear pivotally mounted on the sliding seat and constantly meshed with the feeding mechanism, and a bending mechanism having a right roll die, a left roll die, an upper roll die, and lower roll die each of which has a recess around a circumference thereof adapt to the shape of a tube to be bent, whereby a tube can be conveniently bent into a spiral or a curve as desired.

3 Claims, 4 Drawing Sheets

DEVICE FOR BENDING TUBES

BACKGROUND OF THE INVENTION

1. Field of the Invention

This invention is related to an improved device for bending tubes.

2. Description of the prior Art

It has been found that the most commonly used device for bending tubes simply utilizes a plurality of rollers located at different heights to bend a tube. According to another conventional bending device, the tube to be bent is fitted on the circumference of a circular disk member so that the tube will be bent when the circular disk member is rotated; however, this tube cannot be bent over an angle of 180 degrees, otherwise the tube cannot be disengaged for the circular disk member. Nevertheless, none of the devices can be used for spiraling a tube.

Therefore, it is an object of the present invention to provide a device which can bend a tube into a spiral.

SUMMARY OF THE INVENTION

This invention relates to an improved device for bending tubes.

It is the primary object of the present invention to provide a device for bending tubes which can be used for bending a tube into a spiral.

It is another object of the present invention to provide a device for bending tubes which is simple and sturdy in construction.

It is still another object of the present invention to provide a device for bending tubes which is convenient and reliable in use.

It is still another object of the present invention to provide a device for bending tubes which is facile to manufacture.

It is a further object of the present invention to provide a device for bending tubes which is easy to operate.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
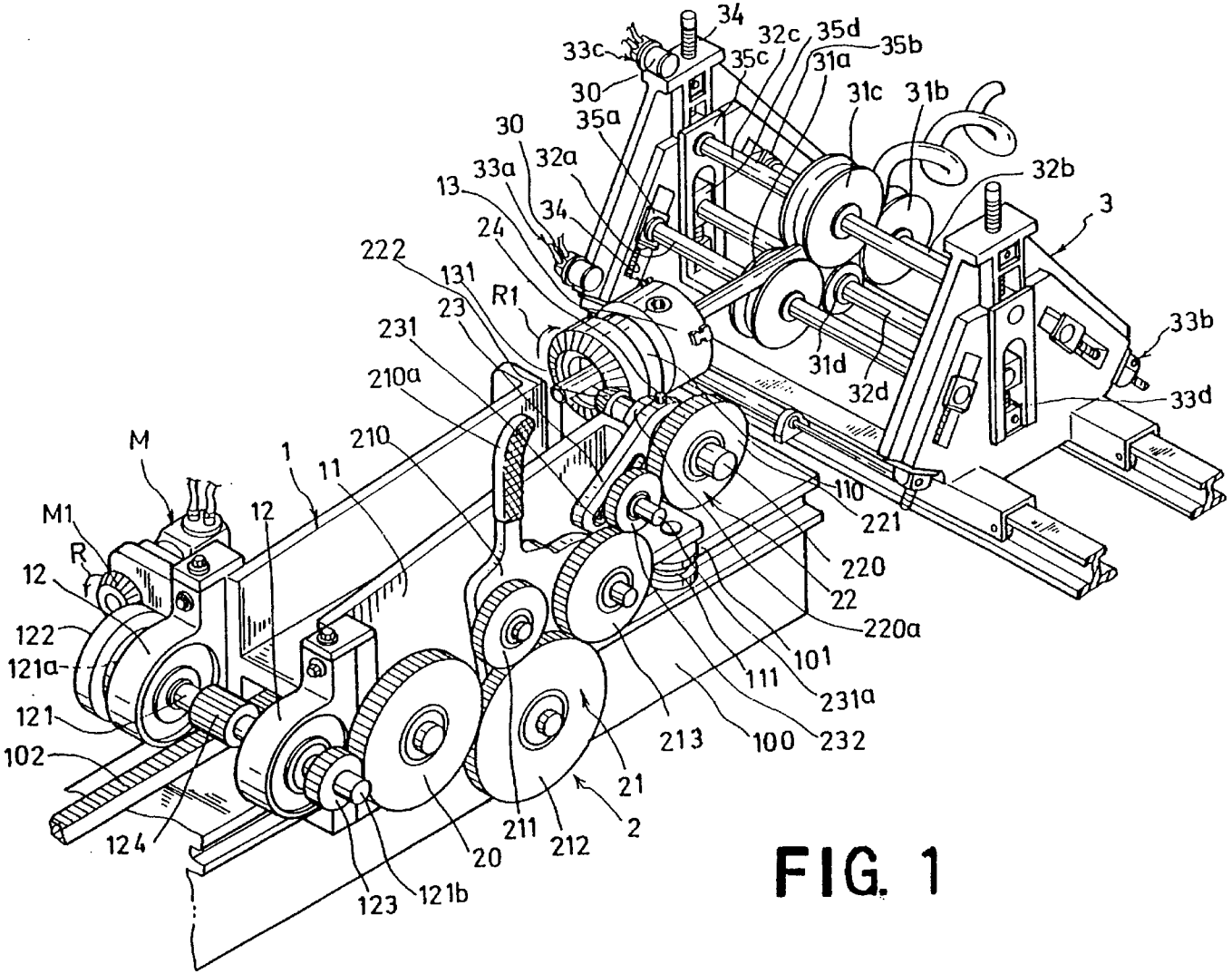
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIG. 1 thereof, the tube bending device according to the present invention mainly comprises an electric motor M, a feeding mechanism 1, a chuck controlling mechanism 2, and a bending mechanism 3. The electric motor M is mounted beside a platform 100 on which are installed the feeding mechanism 1 and the chuck controlling mechanism 2.

The feeding mechanism 1 includes a sliding seat a pair of lugs 12, and a chuck 13. The sliding seat 11 is slidably arranged on the platform 100 and provided with a plurality of pulleys 111 slidably engaged with opposite side rails of the platform 100. The two lugs 12 are secured to the left end (with respect to FIG. 1) of the sliding seat 11 by screws (shown but not numbered). An axle 121 has a first end 121*a* extending through one lug 12 to engage with a gear 122 and a second end 121*b* extending through the other lug 12 to engage with a gear 123. The axle 121 is rotatably supported by the two lugs 12. The gear 122 is threadedly engaged with an output gear M1 of the motor M. The axle 121 is provided at the intermediate portion with a gear 124 meshed with a toothed rack 102 fastened on the top of the platform 100. The chuck 13 may be of three or four jaws and pivotally mounted on the right end (see FIG. 2) of the sliding seat 11. The right end (with respect to FIGS. 1 and 2) of the chuck 13 is fixedly connected with a bevel gear The chuck controlling mechanism 2 includes a direction controlling means 21 and a chuck driving means 22. The direction controlling means 21 includes a plate member 210 pivotally arranged on the sliding seat 11 and three gears 211, 212 and 213 pivotally mounted on the plate member 210. The plate member 210 is provided with an upwardly extending handle 210*a*. The first gear 211 is constantly meshed with the second gear 212 which is in turn constantly engaged with the third gear 213. The chuck driving means 22 includes an arm 23, an axle 220, two gears 221 and 232, and a bevel gear 222. The arm 23 is fixedly mounted on an ear 220*a* of the sliding seat 11 by a screw 24. The axle 220 extends through the arm 23 and the ear 220*a* to engage with the bevel gear 222 and is rotatably supported by the ear 220*a*. The bevel gear 222 is constantly meshed with the bevel gear 131 of the chuck 13. The gear 221 is fixedly mounted on the axle 220. The arm 23 is formed with a slot 231 in which is fixedly mounted an axle 231*a*. The gear 232 is rotatably fitted on the axle 231 and meshed with the third gear 213 of the direction controlling means 21. It should be noted that two additional gears (not shown) may be mounted on the axle 220 and 231*a* to change the revolving speed of the chuck 13.

An idle gear 20 is pivotally mounted on the sliding seat 11 between the gear 123 of the feeding mechanism 1 and the direction controlling means 21 of the chuck controlling mechanism 2. However, if the distance between the gear 123 and the direction controlling means 21 is small, the idle gear 20 will become unnecessary.

The bending mechanism 3 includes a left roll die 31*a*, a right roll die 31*b*, an upper roll die 31*c*, and a lower roll die 31*d* which have a recess around its circumference adapt to the shape of the tube 4. The axles 31*b*, 32*b*, 32*c* and 32*d* of the roll dies 31*a*, 31*b*, 31*c* and 31*d* are respectively connected to elevating mechanisms 33*a*, 33*b*, 33*c* and 33*d* for adjusting the positions thereof.

The elevating mechanisms 33*a*, 33*b*, 33*c* and 33*d* are of the same structure which utilizes a servo motor 30 to drive sliders 35*a*, 35*b*, 35*c* and 35*d* respectively connected with axles 31*a*, 31*b*, 31*c* and 31*d* via a screw rod 34. The servo motor 30 may be driven by hydraulic means or electricity.

Figure 2:
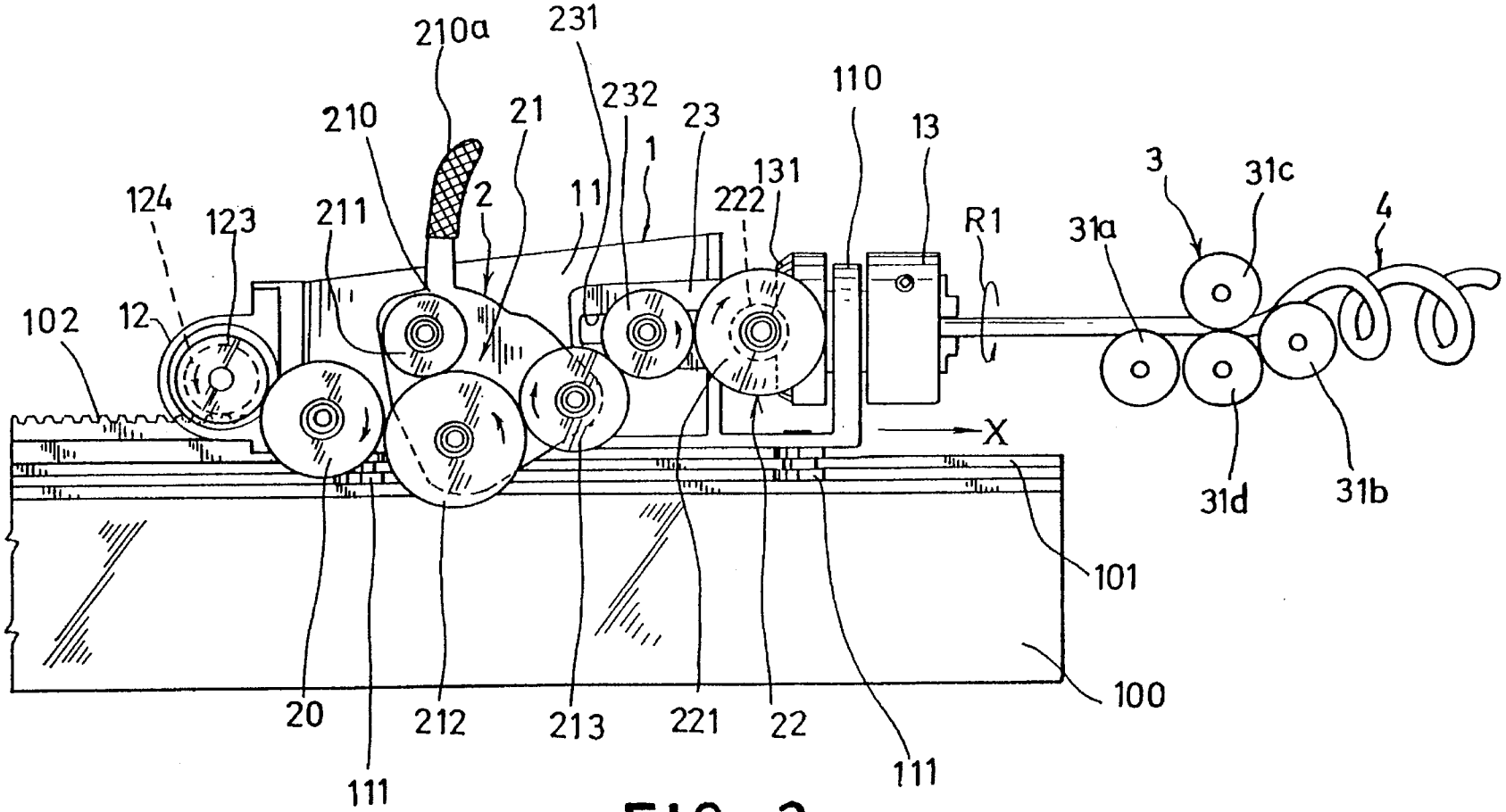
FIG. 2 illustrates how the present invention bends a tube into a spiral in clockwise direction.

As shown in FIGS. 1 and 2, when the handle 210*a* is turned to move the plate member 210 to the right, the gear 212 will mesh with the idle gear 20. In the meantime, a controller (not shown) will be triggered to turn on the electric motor M to rotate in the direction R. The controller may be of any design well known to the art and is not considered a part of the invention. Then, the axle 121 will be rotated to move the sliding seat 11 along the platform 100 in the direction X via the toothed rack 102 thereby forcing the tube 4 to move towards the bending mechanism 3. The gear 123 will drive the gear 212 via the idle gear 20. The gear 212 will drive the gear 213 which will in turn drive the gear 232 thus driving the gear 221. As the gear 221 is fixedly mounted on the axle 220, the axle 220 will be rotated with the gear 221. Then, the axle 220 will rotate the bevel gear 222 which will in turn drive the bevel gear 131 in the direction R1 thereby rotating the chuck 13. Hence, the tube 4 will be twisted into a right hand spiral, as shown in FIG. 1.

Figure 3:
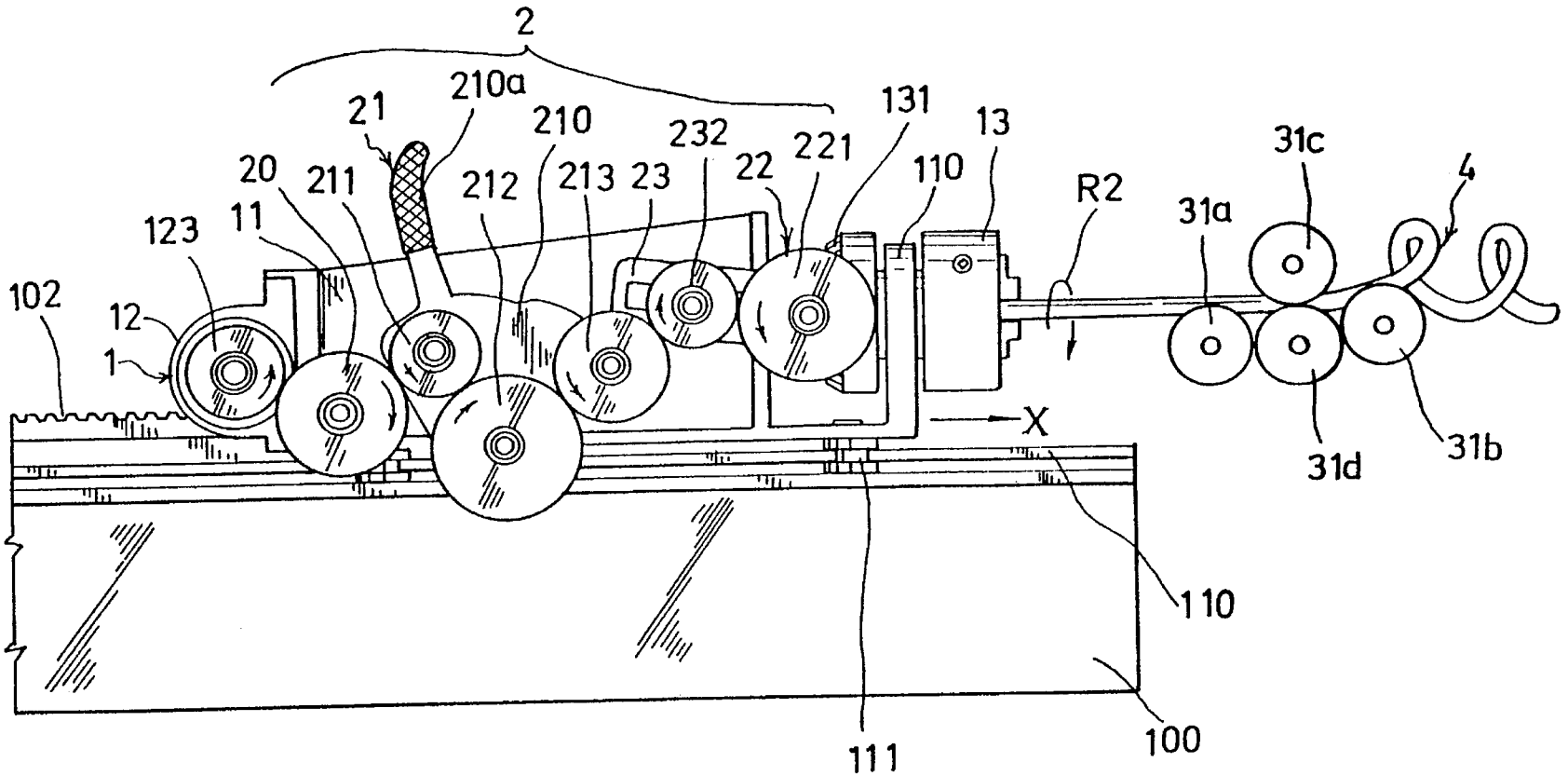
FIG. 3 illustrates how the present invention bends a tube into a spiral in counterclockwise direction.
Figure 4:
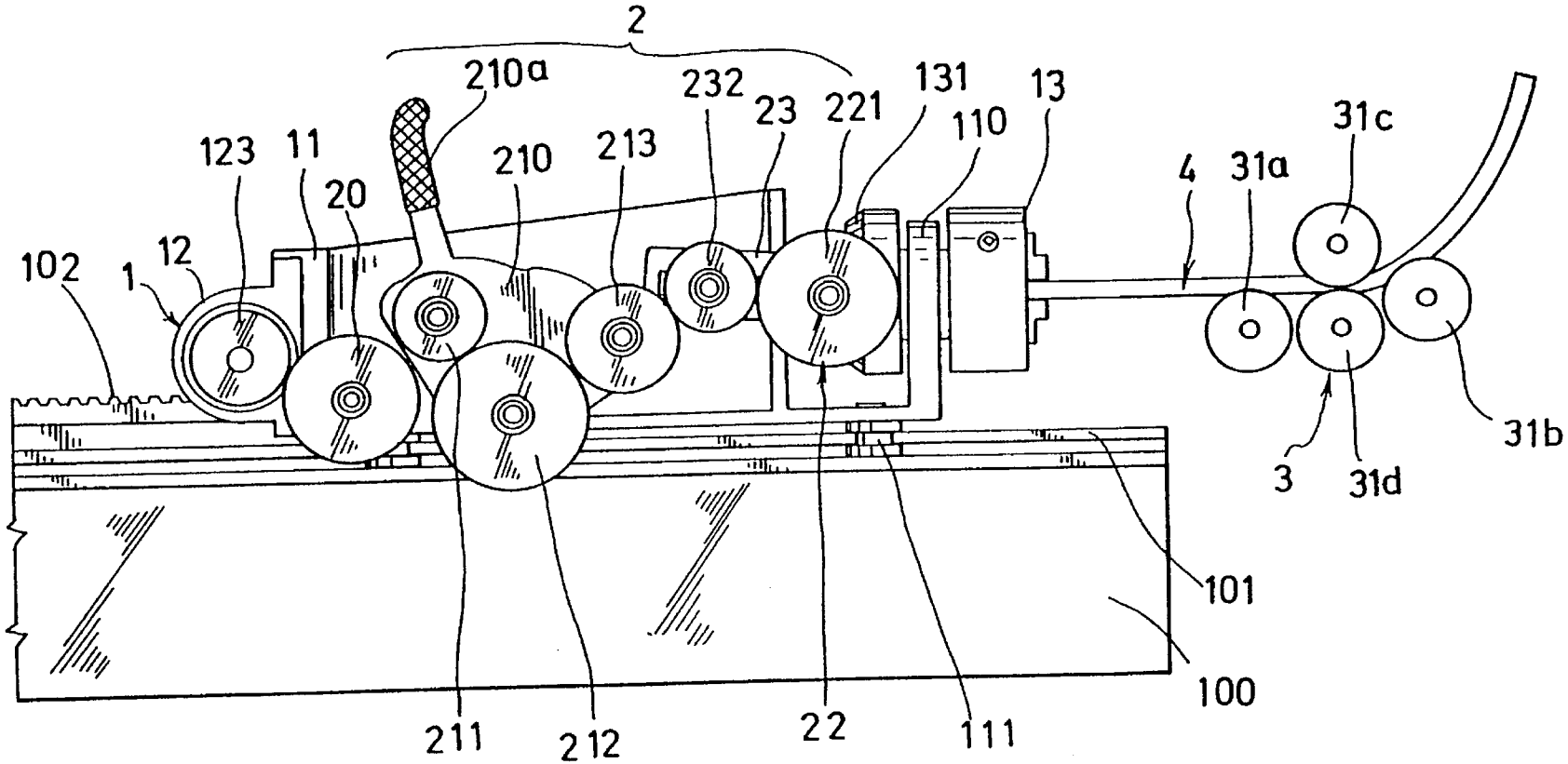
FIG. 4 illustrates how to use the present invention to bend a tube.

As shown in FIG. 3, when the handle 210*a* is turned to move the plate member 210 to the left, the gear 211 will mesh with the idle gear 20. Meanwhile, the controller will be triggered to turn on the electric motor M to rotate in the direction R2. Then, the axle 121 will be rotated to move the sliding seat 11 along the platform 11 in the direction X via the toothed rack 102 thereby forcing the tube 4 to move towards the bending mechanism 3. The gear 123 will drive the gear 211 via the idle gear 20. The gear 211 will drive the gear 212 which will in turn drive the gear 213. Thereafter, the gear 213 will drive the gear 232 thus rotating the gear 221. In the meantime, the axle 220 will rotate the bevel gear 222 which will in turn drive the bevel gear 131 in the direction R2 thereby rotating the chuck. Hence, the tube 4 will be twisted into a left hand spiral.

When desired to bend (not twist) a tube 4, it is only necessary to move the plate member 210 so as to disengage the gears 211 and 212 from the idle gear 20. Then, the chuck 13 will be no longer rotated and the sliding seat 11 will simply push the tube 4 through the bending mechanism thereby bending the tube 4 into a curve.

In conclusion, the present invention makes the tube 4 to rotate and go through the bending mechanism 3 to obtain a spiral member or simply makes the tube 4 to go through the bending mechanism 3 to obtain a curve member as desired. As the roll dies 31*a*, 31*b*, 31*c* and 31*d* have a recess around their circumferences adapt to the shape of the tube 4, the tube 4 can be prevented from deforming in bending process.

Furthermore, the travelling speed of the sliding seat 11 and the rotating speed of the chuck 13 may be adjusted by changing the gears.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A device for bending tubes comprising:

a platform;

a feeding mechanism including a sliding seat, a pair of lugs, and a chuck, said sliding seat being slidably arranged on said platform and provided with a plurality of pulleys slidably engaged with opposite side rails of said platform, said two lugs being secured to an end of said sliding seat by screws, a first axle having a first end extending through one of said lugs to engage with a first gear and a second end extending through another one of said lugs to engage with a second gear, said first axle being rotatably supported by said lugs, said first gear being threadedly engaged with an output gear of a motor drivingly connected with said sliding seat, said first axle being provided at an intermediate portion with a third gear meshed with a toothed rack fastened on a top of said platform, said chuck being pivotally mounted on an end of said sliding seat, the end of said sliding seat being provided with a first bevel gear;

a chuck controlling mechanism including a direction controlling means and a chuck driving means, said direction controlling means including a plate member pivotally arranged on said sliding seat and fourth, fifth and sixth gears pivotally mounted on said plate member, said fourth gear being constantly meshed with fifth gear which is in turn constantly engaged with the sixth gear, said chuck driving means including an arm, a second axle, seventh and eighth gears, and a second bevel gear, said arm being fixedly mounted on an ear of said sliding seat by a screw, said second axle extending through said arm and said ear to engage with said second bevel gear and being rotatably supported by said ear, said second bevel gear being constantly meshed with said first bevel gear, said seventh gear being fixedly mounted on said second axle, said arm being formed with a slot in which is fixedly mounted a third axle, said eighth gear being rotatably fitted on said third axle and meshed with said sixth gear;

an idle gear pivotally mounted on said sliding seat between second gear and said direction controlling means; and a bending mechanism including a first roll die, a second roll die opposite to said first roll die, an upper roll die, and lower roll die each of which has a recess around a circumference thereof adapt to shape of a tube to be bent.

2. The device for bending tubes as claimed in claim 1, wherein said first roll die, said second roll die, said upper roll die and said lower roll die are each connected with an elevating means.

3. The device for bending tubes as claimed in claim 1, wherein said plate member is provided with an upwardly extending handle.

* * * * *